US009248420B2

(12) United States Patent
Rawlings

(10) Patent No.: US 9,248,420 B2
(45) Date of Patent: Feb. 2, 2016

(54) HIGH TURNDOWN IMPELLER

(71) Applicant: Pall Corporation, Port Washington, NY (US)

(72) Inventor: Bruce Rawlings, Hampshire (GB)

(73) Assignee: Pall Corporation, Port Washington, NY (US)

( * ) Notice: Subject to any disclaimer, the term of this patent is extended or adjusted under 35 U.S.C. 154(b) by 232 days.

(21) Appl. No.: 14/107,094

(22) Filed: Dec. 16, 2013

(65) Prior Publication Data

US 2015/0165399 A1 Jun. 18, 2015

(51) Int. Cl.

| | |
|---|---|
| ***B01F 7/22*** | (2006.01) |
| ***B01F 7/06*** | (2006.01) |
| ***B01F 7/00*** | (2006.01) |
| ***B01F 7/16*** | (2006.01) |

(52) U.S. Cl.

CPC ..... *B01F 7/06* (2013.01); *B01F 7/00316* (2013.01); *B01F 7/00341* (2013.01); *B01F 7/162* (2013.01); *B01F 7/22* (2013.01)

(58) Field of Classification Search

CPC .... B01F 7/06; B01F 7/00275; B01F 7/00383; B01F 7/00375; B01F 7/00366; B01F 7/00341; B01F 7/22; B01F 7/162; B01F 7/00316

USPC ..... 366/270, 330.1–330.7; 416/237

See application file for complete search history.

(56) References Cited

U.S. PATENT DOCUMENTS

| | | | | |
|---|---|---|---|---|
| 3,030,083 | A * | 4/1962 | Stiffler | B01F 7/00475 366/316 |
| 3,147,958 | A * | 9/1964 | Stiffler | A47J 43/0722 241/98 |
| 3,158,359 | A * | 11/1964 | Stiffler | B01F 7/00291 416/231 A |
| 4,189,157 | A | 2/1980 | Mahan et al. | |
| 5,297,938 | A | 3/1994 | Von Essen et al. | |
| 5,595,475 | A | 1/1997 | Weiss et al. | |
| 6,708,985 | B1 | 3/2004 | Doyle | |
| 6,896,246 | B2 | 5/2005 | Weetman et al. | |
| 6,935,771 | B2 | 8/2005 | Engel | |
| 7,090,223 | B2 | 8/2006 | Reinhard | |
| 7,114,844 | B2 | 10/2006 | Weetman | |
| 7,523,644 | B2 | 4/2009 | Van Winkle | |
| 7,552,885 | B2 * | 6/2009 | Katz | B01F 7/00275 241/282.1 |
| 7,765,853 | B2 | 8/2010 | Safai et al. | |

(Continued)

FOREIGN PATENT DOCUMENTS

| | | | | |
|---|---|---|---|---|
| DE | 9418136 | U1 * | 12/1994 | B01F 7/00341 |
| DE | 19720120 | C2 * | 3/2001 | B01F 7/00341 |

(Continued)

*Primary Examiner* — Charles Cooley

(74) *Attorney, Agent, or Firm* — Leydig, Voit & Mayer

(57) ABSTRACT

A bioprocessing mixing vessel comprising a closed container comprising a rotatable impeller comprising a hub having extending arms, each arm comprising upper and lower edges, hub and terminal ends, arm outer and inner faces, and a length from the hub end to the terminal end, the terminal end further comprises a protrusion extending from the lower edge, the protrusion comprising first and second ends, protrusion outer and inner faces, and having a distance between the first and second ends, the protrusion outer face forming an angle in the range of from at least about 45° to about 90° with respect to the arm outer face, wherein the distance between the first and the second ends of the protrusion is about 25% to about 60% of the length from the hub end to the terminal end; and methods of using the mixing vessel, are provided.

8 Claims, 5 Drawing Sheets

(56) References Cited

U.S. PATENT DOCUMENTS

| | | | | |
|---|---|---|---|---|
| 7,887,230 | B2 | 2/2011 | Rosso et al. | |
| 8,096,169 | B2 | 1/2012 | Bearden et al. | |
| 8,123,199 | B2 | 2/2012 | Terentiev et al. | |
| 8,505,924 | B2 | 8/2013 | Dietle et al. | |
| 9,073,023 | B2 * | 7/2015 | Bernard | B01F 3/1207 |
| 2006/0280028 | A1 | 12/2006 | West et al. | |
| 2011/0003374 | A1 | 1/2011 | Van Den Boogaard et al. | |
| 2011/0058447 | A1 | 3/2011 | Reif et al. | |
| 2012/0218855 | A1 | 8/2012 | Kunas et al. | |
| 2014/0369157 | A1 | 12/2014 | Bernard et al. | |
| 2015/0044057 | A1 * | 2/2015 | Dinnison | B01F 7/00366 416/237 |
| 2015/0165399 | A1 * | 6/2015 | Rawlings | B01F 7/06 366/265 |

FOREIGN PATENT DOCUMENTS

| | | | | |
|---|---|---|---|---|
| EP | 2 205 496 | B1 | 7/2010 | |
| EP | 2883602 | A1 * | 6/2015 | B01F 7/06 |
| JP | 09-38962 | A | 2/1997 | |
| JP | 2006-000813 | A | 1/2006 | |
| WO | WO 2005-068059 | A1 | 7/2005 | |
| WO | WO 2007/050971 | A1 | 5/2007 | |
| WO | WO 2010/125006 | A1 | 11/2010 | |
| WO | WO 2011/071521 | A1 | 6/2011 | |
| WO | WO 2011-122370 | A1 | 10/2011 | |

* cited by examiner

HIGH TURNDOWN IMPELLER

BACKGROUND OF THE INVENTION

The preparation of fluids, particularly solutions and suspensions in the pharmaceutical and biopharmaceutical industries, typically involves thorough mixing to provide the desired distribution of ingredients in the product. Many mixing operations are carried out in stainless steel vessels with a mixing impeller mounted near the base of the vessel, and the impeller can be operated as fluid is drained from the bottom of the vessel.

However, there is a need for improved impellers and mixing vessels including impellers.

The present invention provides for ameliorating at least some of the disadvantages of the prior art. These and other advantages of the present invention will be apparent from the description as set forth below.

BRIEF SUMMARY OF THE INVENTION

An embodiment of the invention provides an impeller for use in bioprocessing, the impeller comprising (a) a rotatable hub; (b) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (c) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm. Preferably, the impeller further comprises a rotatable shaft comprising a cylindrical element having a first end and a second end, the shaft having a vertical rotational axis, wherein the hub is mounted on the first end of the rotatable shaft, and the hub has a horizontal axis perpendicular to the vertical rotational axis of the shaft.

In another embodiment, a mixing vessel for use in bioprocessing is provided, comprising (a) a biocontainer comprising a closed container having an interior volume suitable for containing fluid, the container comprising a bottom wall, a top wall, at least one side wall, the side wall(s) being joined to the top wall and the bottom wall; and at least an inlet port, and a drain port, the drain port being arranged in the bottom wall, wherein the biocontainer further comprises: (b) a rotatable agitator comprising an impeller and a housing assembly, the impeller comprising (i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall; (ii) a hub mounted on the first end of the rotatable shaft, the hub having a horizontal axis perpendicular to the vertical rotational axis of the shaft; (iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and (v) the housing assembly mounted to the bottom wall of the biocontainer, the housing assembly comprising a bearing and a seal; the housing assembly sealingly supporting the rotatable shaft, wherein the second end of the shaft passes through the housing assembly.

A method of preparing a mixed fluid used in bioprocessing according to another embodiment of the invention method comprises (a) passing at least one fluid and at least one component to be mixed with the fluid through an inlet port into a biocontainer comprising a closed container having an interior volume, the container comprising a bottom wall, a top wall, at least one wall, the side wall(s) being joined to the top wall and the bottom wall; and at least the inlet port, and a drain port, the drain port being arranged in the bottom wall, wherein the biocontainer further comprises a rotatable impeller, the impeller comprising: (i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall; (ii) a hub mounted on the first end of the rotatable shaft, the hub having a horizontal axis perpendicular to the vertical rotational axis of the shaft; (iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and, (b) rotating the impeller, and mixing the at least one fluid and the at least one component to be mixed with the fluid, and producing the mixed fluid.

BRIEF DESCRIPTION OF THE SEVERAL VIEWS OF THE DRAWING(S)

DETAILED DESCRIPTION OF THE INVENTION

Figure 1A:
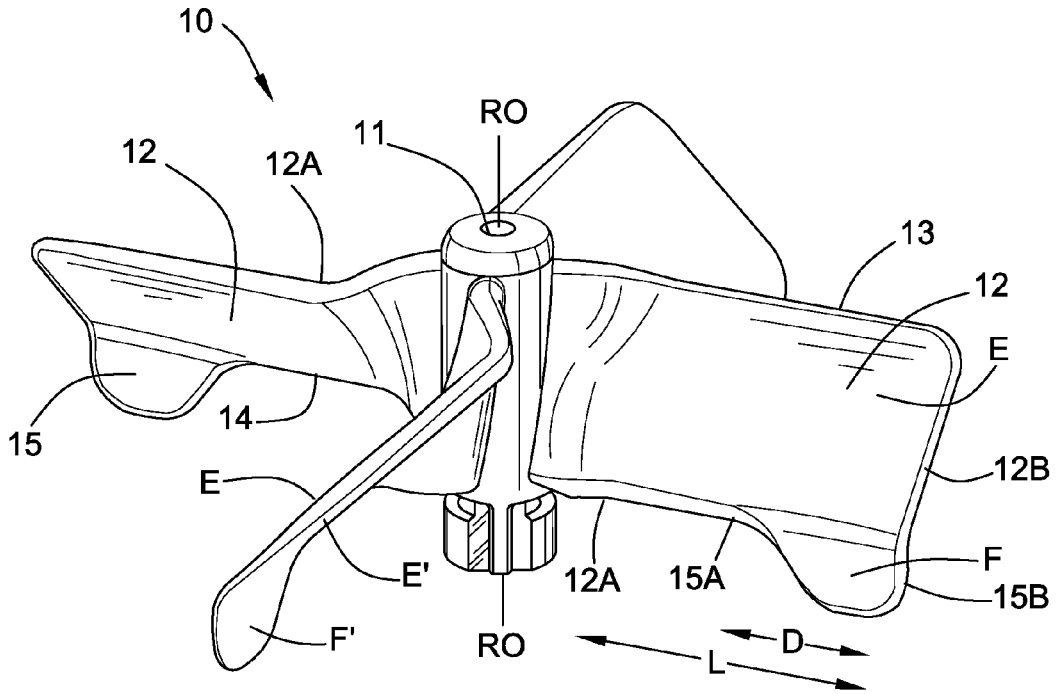
FIG. 1 (A-B) shows a perspective view (FIG. 1A) and a side view (FIG. 1B) of an impeller according to an embodiment of the invention.

Advantageously, a desired distribution of ingredients in a mixed fluid can be provided, and a greater volume of the mixed fluid can be obtained for further use. Mixing operations performed by an impeller mounted on the bottom wall of a mixing vessel will have a minimum volume that can be mixed that is determined by the geometry of the vessel and the height at which the impeller is mounted. The relationship between the maximum mixing volume and the minimum mixing volume is referred to as the "turn down ratio." Embodiments of the invention provide an improved turn down ratio compared to conventional mixing vessels with bottom mounted impellers, and as a result, embodiments of the invention have a lower minimum mixing volume compared to such conventional mixing vessels. Advantageously, smaller starter volumes of fluid can be mixed successfully. Alternatively, or additionally, fluid can continue to be mixed and agitated as the fluid is drained from the mixing vessel, which maintains the homogeneity of the mixed fluid.

Without being limited to any particular mechanism, it is believed that by having a portion of the bottom edge of the impeller extend downward toward the mixing vessel base (i.e., extending into the traditionally unmixed portion of fluid), better performance is obtained as compared to lowering the height at which is conventional mixing blade is mounted.

An embodiment of the invention provides an impeller for use in bioprocessing, the impeller comprising a rotatable hub having (a) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (b) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm. Preferably, the impeller further comprises a rotatable shaft comprising a cylindrical element having a first end and a second end, the shaft having a vertical rotational axis, wherein the hub is mounted on the first end of the rotatable shaft, and the hub has a horizontal axis perpendicular to the vertical rotational axis of the shaft.

In accordance with another embodiment of the present invention, an impeller for use in bioprocessing is provided comprising (a) a rotatable shaft comprising a cylindrical element having a first end and a second end, the shaft having a vertical rotational axis; (b) a hub mounted on the first end of the rotatable shaft, the hub having a horizontal axis perpendicular to the vertical rotational axis of the shaft; (c) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (d) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm.

In another embodiment, a mixing vessel for use in bioprocessing is provided, comprising (a) a biocontainer comprising a closed container having an interior volume suitable for containing fluid, the container comprising a bottom wall, a top wall, at least one side wall, the side wall(s) being joined to the top wall and the bottom wall; and at least an inlet port, and a drain port, the drain port being arranged in the bottom wall, wherein the biocontainer further comprises: (b) a rotatable agitator comprising an impeller and a housing assembly, the impeller comprising (i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall; (ii) a hub mounted on the first end of the rotatable shaft, the hub having a horizontal axis perpendicular to the vertical rotational axis of the shaft; (iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and (v) the housing assembly mounted to the bottom wall of the biocontainer, the housing assembly comprising a bearing and a seal; the housing assembly sealingly supporting the rotatable shaft, wherein the second end of the shaft passes through the housing assembly.

A method of preparing a mixed fluid used in bioprocessing according to another embodiment of the invention method comprises (a) passing at least one fluid and at least one component to be mixed with the fluid through an inlet port into a biocontainer comprising a closed container having an interior volume, the container comprising a bottom wall, a top wall, at least one wall, the side wall(s) being joined to the top wall and the bottom wall; and at least the inlet port, and a drain port, the drain port being arranged in the bottom wall, wherein the biocontainer further comprises a rotatable impeller, the impeller comprising: (i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall; (ii) a hub mounted on the first end of the rotatable shaft, the hub having a horizontal axis perpendicular to the vertical rotational axis of the shaft; (iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises: (iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and, (b) rotating the impeller, and mixing the at least one fluid and the at least one component to be mixed with the fluid, and producing the mixed fluid.

Each of the components of the invention will now be described in more detail below, wherein like components have like reference numbers.

Figure 1B:
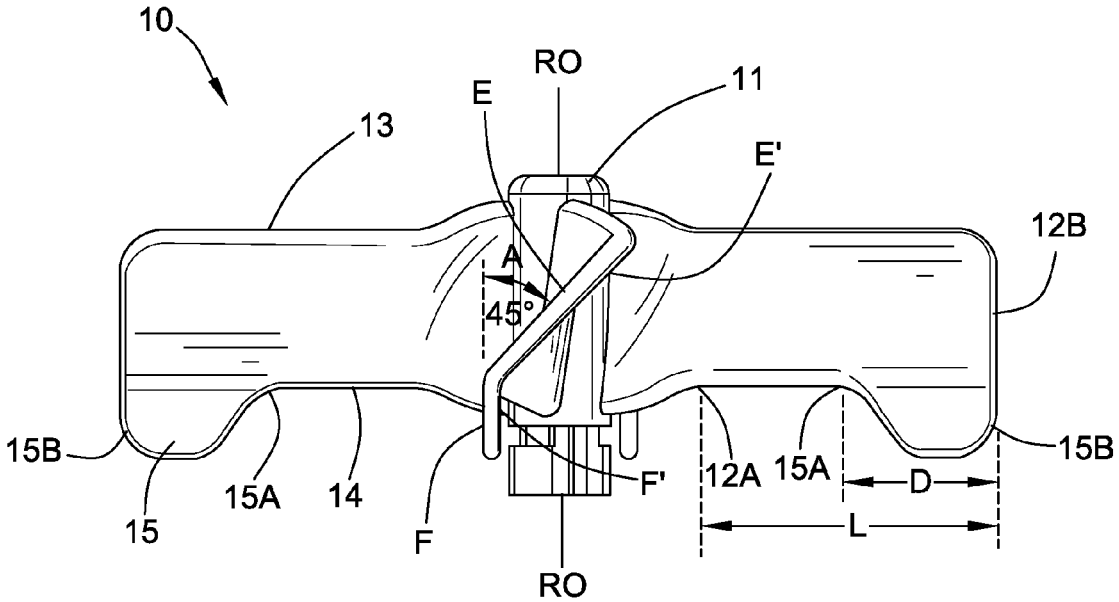

FIG. 1 shows an illustrative rotatable impeller in perspective view (FIG. 1A) and side view (FIG. 1B). In this illustrated embodiment, impeller 10 comprises a hub 11 and four arms 12 extending from the hub, each arm 12 comprising an upper edge 13, a lower edge 14, a hub end 12A, a terminal end 12B, an arm outer face E, an arm inner face E', and a length L from the hub end to the terminal end, wherein the hub end of the arm is connected to the hub, and the terminal end of the arm further comprises a protrusion 15 extending from the lower edge of the arm, the protrusion comprising a first end 15A, a second end 15B, a protrusion outer face F, a protrusion inner face F' (the faces F and F' arranged vertically in use), and having a distance D between the first end and the second end, the first end arranged between the hub end of the arm and the terminal end of the arm, and the second end extending to the terminal end of the arm, the protrusion outer face F forming an angle A in the range of from at least about 45° to about 90° with respect to the arm outer face E, wherein the distance between the first and the second ends of the protrusion is in the range of from about 25% to about 60% of the length from the hub end of the arm to the terminal end of the arm. Using FIGS. 1A, 1B, and 5 for general reference, in use in a mixing vessel, the protrusion extends downward toward the mixing vessel base, preferably wherein the protrusion's face is perpendicular or nearly perpendicular to the vessel base.

The arms 12 can be arranged at an angle of about 45° to about 90° with respect to the rotational axis (RO) of the hub, and in the illustrated embodiment, the arms are arranged at an angle of about 45° with respect to the rotational axis of the hub. In the embodiment illustrated in FIG. 1B, the protrusion outer face F forms an angle A of about 45° with respect to the arm outer face E, and the distance between the first and the second ends of the protrusion is about 50% of the length from the hub end of the arm to the terminal end of the arm.

Figure 2:
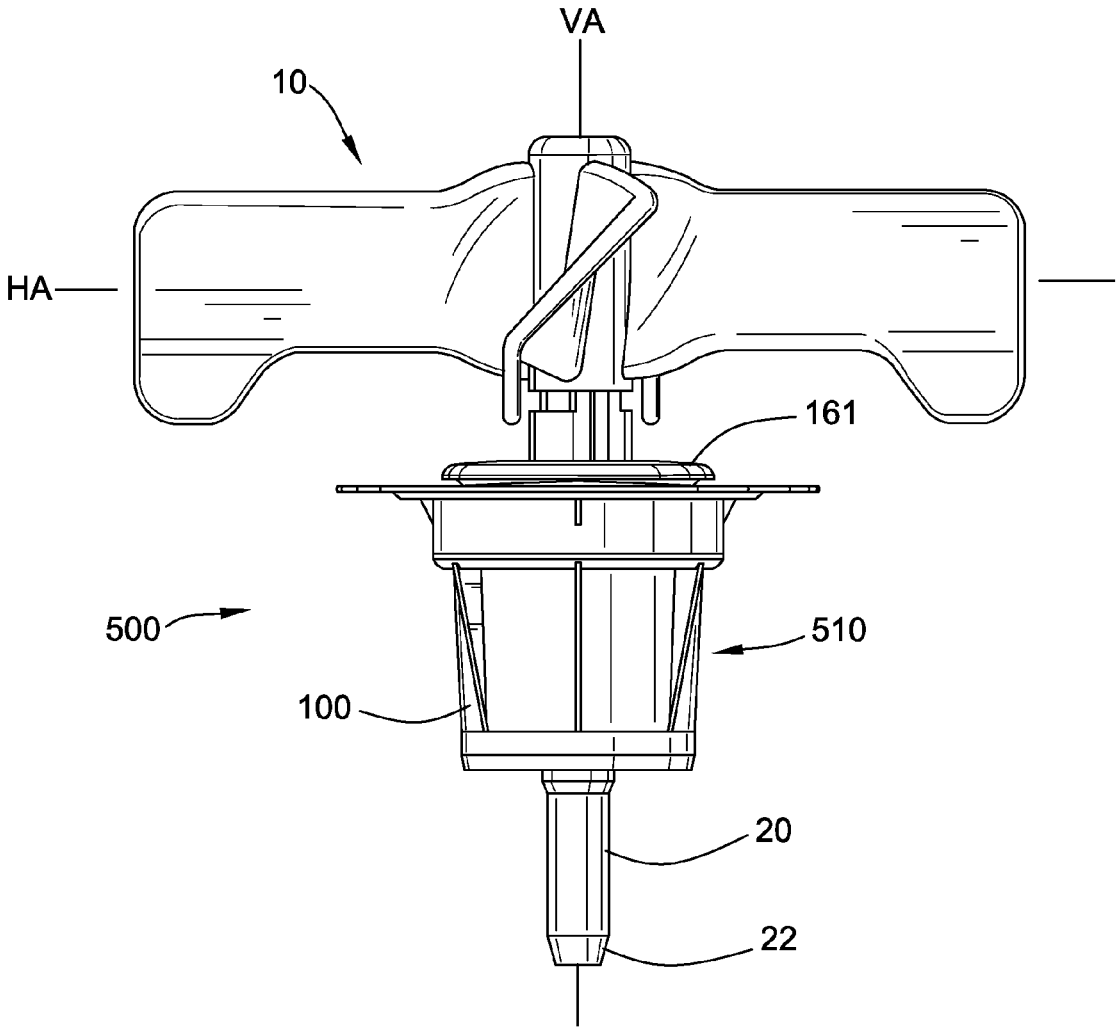
FIG. 2 is a side view of an assembled agitator according to an embodiment of the present invention, comprising the impeller as shown in FIG. 1, and a seal housing.

Typically, the rotatable impeller is a mechanically driven impeller and further comprises a rotatable shaft comprising a cylindrical element having a first end and a second end, wherein the hub is attached to the first end of the rotatable shaft, and the hub has a horizontal axis (HA) perpendicular to the vertical rotational axis of the shaft. FIG. 2 shows the impeller 10 attached to rotatable shaft 20 (having a vertical rotational axis VA and a horizontal axis (HA)) comprising a cylindrical element having a first end 21 (shown in FIG. 3) and a second end 22.

Another embodiment of the invention comprises an agitator, comprising an embodiment of the impeller (attached to the rotatable shaft), and a housing assembly, comprising at least one bearing and at least one seal, wherein the housing assembly sealingly supporting the rotatable shaft, and wherein the second end of the shaft passes through the housing assembly.

FIGS. 2 (assembled view) and 3 (exploded view) show an embodiment of a mechanically driven agitator 500 according to an embodiment of the invention, the agitator 500 comprising an impeller 10 as described above attached to a rotatable shaft 20 (also as described above), the agitator further comprising a housing assembly 510.

Figure 3:
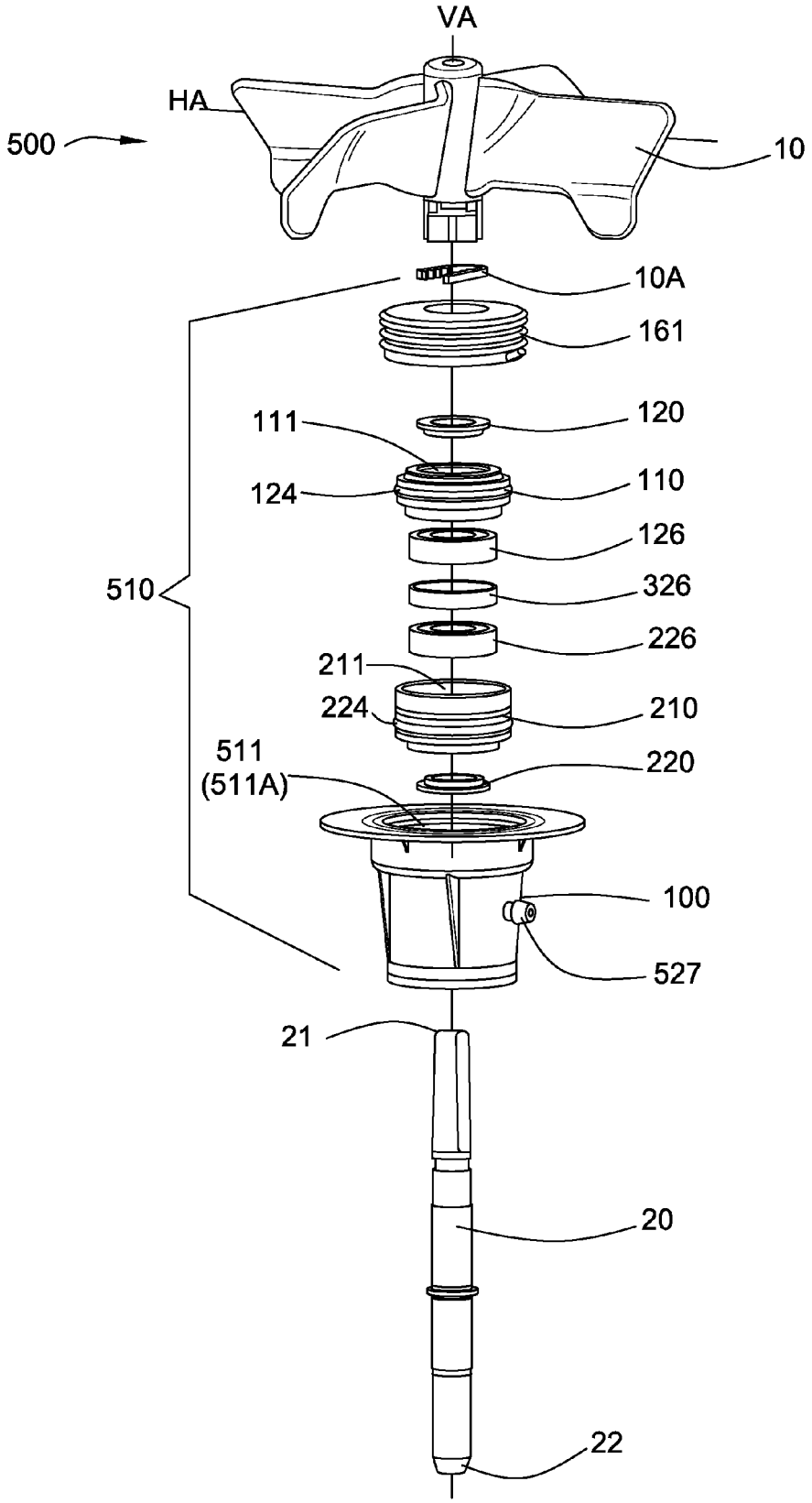
FIG. 3 is an exploded view of the agitator shown in FIG. 2.

Using FIG. 3 for reference, the illustrated seal housing assembly 510 comprises a housing 100 having a cavity 511, wherein the housing assembly comprises an upper seal assembly 110 and a lower seal assembly 210, and a central channel 511A passing through the seal housing assembly and the upper and lower seal assemblies 110, 210, wherein the cavity 511 receives the upper and lower seal assemblies 110, 210, and the shaft 20 passes through the cavity 511 and central channel 511A.

As shown in more detail in FIG. 3, the illustrated upper seal assembly 110 and lower seal assembly 210 each have a central channel 111, 211 respectively (for receiving the rotatable shaft 20) and each comprise respective seals 120, 220 with annular openings (e.g., a commercially available seal comprising an energizing spring and a sealing lip, such as, for example, VARISEAL (Trelleborg Sealing Solutions)), each seal assembly further comprising a resilient ring 124, 224, and a bearing 126, 226 (wherein the bearings are fit onto the shaft 20). In this illustrated embodiment, a bearing spacer 326 is interposed between the bearings 126 and 226. Preferably, the resilient rings 124, 224 compress when fitting the seal assemblies into the housing 100 of the seal housing assembly 510. Typically, as shown in FIG. 3, an end cap 161 is inserted to retain the seal assemblies in the housing 100, and FIG. 3 illustrates the cap as threaded into the housing 100. FIG. 3 also illustrates an impeller retaining clip 10A engaged with the shaft and a portion of the hub.

FIG. 3 also illustrates an integrity testing assembly comprising the portion of central channel 511A communicating with the upper seal assembly 110 and the lower seal assembly 210, and a port 527 communicating with the central channel 511A.

Figure 4:
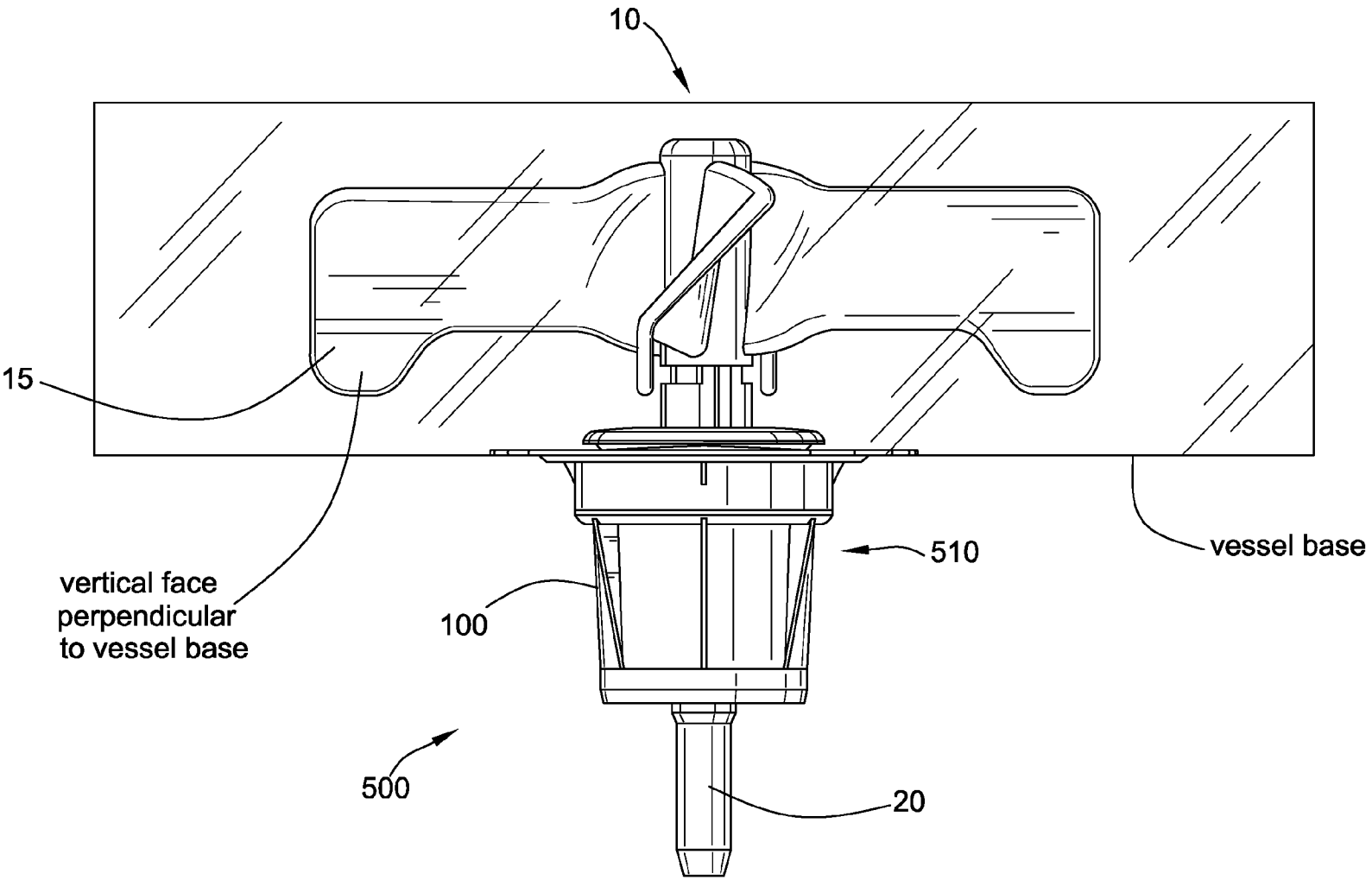
FIG. 4 is a side view of an agitator according to an embodiment of the present invention, comprising the agitator as shown in FIG. 2, wherein the agitator is mounted to a bottom wall of a biocontainer of a mixing vessel.

As noted above, the impeller has a portion facing downward toward the mixing vessel base, preferably with the protrusion's face perpendicular to the vessel base. FIG. 4 shows an embodiment of the impeller (illustrated as part of an agitator) with the protrusion facing downwardly toward a bottom wall of a biocontainer or bioprocessing container of a mixing vessel, wherein the housing assembly is mounted to the bottom wall, and the housing assembly sealingly supporting the rotatable shaft, wherein the second end of the shaft passes through the housing assembly.

Figure 5:
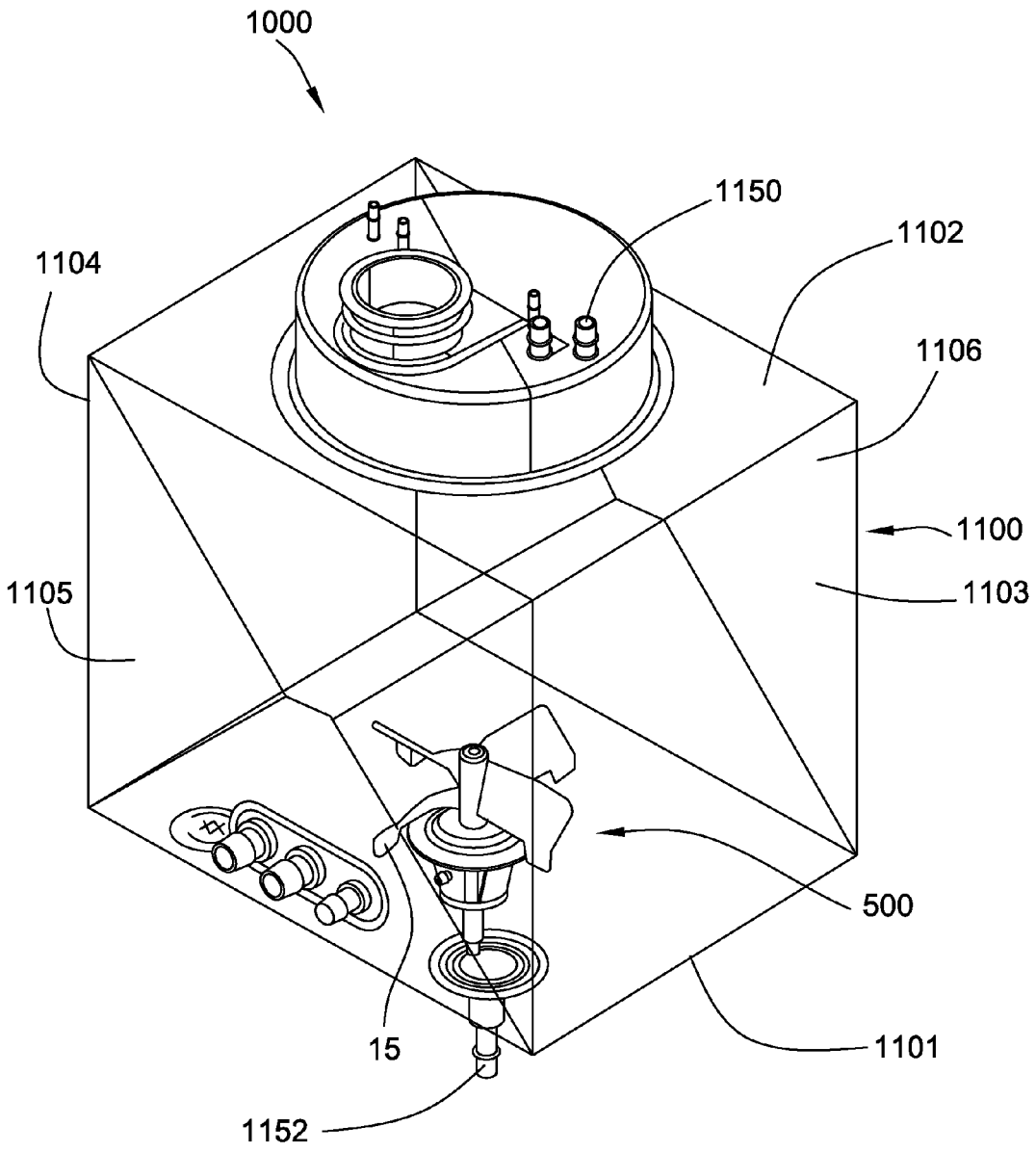
FIG. 5 is a perspective view of a mixing vessel according to an embodiment of the present invention, including the agitator shown in FIG. 2, mounted to the bottom wall of the biocontainer of the mixing vessel.

An illustrative mixing vessel 1000 comprising a closed biocontainer or closed bioprocessing container 1100 comprising a bottom wall 1101, a top wall 1102, and opposing side walls 1103, 1104, and 1105, 1106, and including a plurality of ports including at least one inlet port 1150 and a drain port 1152, and having an interior volume suitable for containing fluid, and having the agitator 500 mounted to the bottom wall 1101 of the biocontainer 1100, is shown in FIG. 5, wherein the vertical face of the protrusion 15 of the impeller is perpendicular to the bottom wall 1101. The biocontainer (or bioprocessing container), which is flexible (e.g., plastic), can have any suitable form (e.g., cylindrical (having, for example, a single continuous side wall), square, or rectangular), and in FIG. 5 is illustrated as having a generally rectangular cuboid form with a plurality of side walls.

Embodiments of the mixing vessel can have any suitable number and locations of ports, for example, one or more of any of the following ports: a liquid inlet port, a gas inlet port, a gas outlet port, a powder inlet port, an acid/base inlet port, a probe port, and/or a sample port.

Using FIG. 5 for reference, a method of preparing a mixed fluid used in bioprocessing according to an embodiment of the invention method comprises passing at least one fluid and at least one component to be mixed with the fluid through one or more ports into the biocontainer, rotating the impeller, and mixing the at least one fluid and the at least one component to be mixed with the fluid, and producing the mixed fluid.

Typically, the method further comprises passing mixed fluid from the interior volume of the biocontainer through the drain port while rotating the impeller.

In some embodiments, the method includes obtaining a turndown ratio of at least about 20, for example, a turndown ratio of at least about 25, or at least about 30.

If desired, embodiments of the method can further comprise, for example, one or more of any of the following: determining and/or adjusting the pH in the container, adding one or more liquids, adding one or more dried ingredients, taking one or more samples, determining and/or adjusting the $O_2$ in the container, and/or determining and/or adjusting the $CO_2$ in the container.

A variety of fluids can be processed and/or prepared (including mixing) in accordance with embodiments of the invention. Applications include, for example, cell culture (e.g., including batch and fed-batch operations of suspension and adherent cell lines), preparing sterile fluids for the pharmaceutical and/or biopharmaceutical industries, including drugs, vaccines, and intravenous fluids, antibody- and/or protein-containing fluids, and/or fluids for the food and beverage industry. Fluids mixed according to embodiments of the invention can also used, for example, as media and/or buffers such as chromatography buffers.

An embodiment of a method for testing seal integrity of a mechanically driven agitator according to an embodiment of the invention comprises applying pressure to the port 527 communicating with the internal channel 511A (shown in FIG. 3), and the pressure is analyzed over a period of time to see if the pressure is maintained, thus showing the integrity of the seals is maintained. If the pressure has decayed, the integrity of one of the seals has been breached. Illustratively, an impeller can be pressurized at about 0.6 barg for 6 minutes, and the pressure decay analyzed.

The following examples further illustrate the invention but, of course, should not be construed as in any way limiting its scope.

Example 1

This example demonstrates an improvement in agitated fluid volume and turndown ratio in a disposable mixing vessel comprising a bottom mounted impeller according to an embodiment of the invention, compared to a conventional impeller mounted in the same position relative to the base of the vessel.

A 50 mL mixer bag (low density polyethylene) is obtained, and an agitator comprising an impeller according to an embodiment of the invention is mounted on the bottom. The shaft is stainless steel bar having smooth surfaces where it mates with the rotary seals and bearings, which are housed within an injection molded seal housing welded by heat and pressure to the bag film. The arms and hub are injection molded to form a unitary piece, that is fit over the end of the shaft. The bag is mounted in a tote that supports the bag, wherein the tote also includes a motor arranged to drive the impellers. The impeller and agitator according to the invention are shown in FIGS. 1-3, and the bag is as generally shown in FIG. 5. The arms 12 extend outwardly from the shaft at an angle of about 45° from the rotational axis of the impeller, and the angle A from the outer face F of the protrusion and the outer face E of the arm is about 45° (the angle from the inner face F' of the protrusion and the inner face E' of the arm is about 135°). The impeller has a distance between the first and the second ends of the protrusion of about 50% of the length from the hub end of the arm to the terminal end of the arm. The protrusion 15 extends downward toward the mixing vessel base such that the face is perpendicular to the floor of the bag.

50 mL of water is added and the motor is started. The impeller is kept running as the fluid is drained from the bag. The volume at which the fluid stopped being agitated is found by stopping the draining operation once agitation ceased.

The fluid volume is measured and compared to the volume that would have been achieved with a traditional impeller mounted in the same position relative to the base of the bag.

The volume that would have been achieved with a traditional impeller mounted in the same position relative to the base of the bag is calculated as follows:

The minimum mixing volume=(width)×(length)×(height to edge of impeller). The width of the bag is 34 cm, the length is 44 cm, the height to the bottom of the traditional impeller is 2.6 cm. Thus, the minimum mixing volume is 3890 cc (3.89 L).

The unagitated fluid volume in a mixing vessel with a traditional impeller is about 4 L, whereas the unagitated fluid volume in the mixing vessel using an impeller according to an embodiment of the invention is in the range of about 1.4 L to about 2 L. Thus, the turn down ratio (start volume/unagitated volume) with a traditional impeller is 13 (50 L/3.89 L), whereas the turn down ratio using an impeller according to an embodiment of the invention is in the range of about 25 (50 L/2 L) to about 36 (50 L/1.4 L).

Example 2

This example demonstrates improvements in mixing using impellers according to embodiments of the invention, compared to a traditional impeller.

Two impellers are prepared according to embodiments of the invention. The first impeller is configured as described in Example 1, and as generally shown in FIG. 1B.

The second impeller is configured similarly, but has a distance between the first and the second ends of the protrusion of about 95% of the length from the hub end of the arm to the terminal end of the arm (in contrast with about 50% for the first impeller).

A traditional impeller is obtained, without a protrusion.

The impellers are mounted in mixer bags and the bags are mounted in totes as generally described in Example 1. Each bag contains 40 L of glycerine (a high viscosity fluid).

The impellers are set for 200 rpm, forward direction, and run for 1 minute. A camera is activated to take pictures at 0.5 second intervals. Two ml of red food dye is added.

As evidenced by the flow of dye over time, the traditional impeller provided axial flow, moving the bulk of the fluid upward, but with little radial component.

Both impellers according to embodiments of the invention provided axial flow and radial flow, enabling the dye to be mixed more efficiently through the width as well as the height of the glycerine, resulting in faster mixing times. After about 15 seconds, both impellers provide a homogenous solution, whereas the traditional impeller provides a homogenous solution after about 40 seconds. Thus, impellers according to embodiments of the invention decreased the mixing time by over 50% when compared to the traditional impeller. The impeller having the shorter protrusion provides slightly faster mixing than the impeller with the longer protrusion.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of preparing a mixed fluid used in bioprocessing, the method comprising:

(a) passing at least one fluid and at least one component to be mixed with the fluid through an inlet port into a biocontainer comprising a closed container having an interior volume, the container comprising a bottom wall, a top wall, at least one wall, the side wall(s) being joined to the top wall and the bottom wall; and at least the inlet port, and a drain port, the drain port being arranged in the bottom wall, wherein the biocontainer further comprises a rotatable agitator comprising an impeller and a housing assembly mounted to the bottom wall of the biocontainer, the impeller comprising:

(i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall;

(ii) a hub mounted on the first end of the rotatable shaft, the hub having a horizontal axis perpendicular to the vertical rotational axis of the shaft;

(iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises:

(iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and, (b) rotating the impeller, and mixing the at least one fluid and the at least one component to be mixed with the fluid, and producing the mixed fluid.

2. The method of claim 1, further comprising passing mixed fluid from the interior volume of the biocontainer through the drain port while rotating the impeller.

3. The method of claim 2, comprising obtaining a turndown ratio of at least about 20.

4. The method of claim 1, comprising obtaining a turndown ratio of at least about 20.

5. A mixing vessel for use in bioprocessing comprising:

(a) a biocontainer comprising a closed container having an interior volume suitable for containing fluid, the container comprising a bottom wall, a top wall, at least one side wall, the side wall(s) being joined to the top wall and the bottom wall; and at least an inlet port, and a drain port, the drain port being arranged in the bottom wall, wherein the biocontainer further comprises:

(b) a rotatable agitator comprising an impeller and a housing assembly, the impeller comprising (i) a rotatable shaft comprising a cylindrical element having a first end and a second end, the shaft having a vertical rotational axis, the shaft passing through the bottom wall of the biocontainer such that the first end extends into the interior volume of the container and the second end extends exterior to the bottom wall;

(ii) a hub mounted on the first end of the rotatable shaft, the hub having a horizontal axis perpendicular to the vertical rotational axis of the shaft;

(iii) at least two arms extending from the hub, each arm comprising an upper edge, a lower edge, a hub end, a terminal end, an arm outer face, an arm inner face, and a length from the hub end to the terminal end, wherein the hub end of the arm is connected to the hub, and the terminal end of the arm further comprises:

(iv) a protrusion extending from the lower edge of the arm, the protrusion comprising a first end, a second end, a protrusion outer face, a protrusion inner face, and having a distance between the first end and the second end, the first end arranged between the hub end of the arm and the terminal end of the arm, and the second end extending to the terminal end of the arm, the protrusion outer face forming an angle in the range of from at least about 45° to about 90° with respect to the arm outer face, wherein the distance between the first and the second ends of the protrusion is in the range of from about 25% to about 60% of the length from the hub end of the arm to the terminal end of the arm; and (v) the housing assembly coupled to the bottom wall of the biocontainer, the housing assembly comprising a bearing and a seal; the housing assembly sealingly supporting the rotatable shaft, wherein the second end of the shaft passes through the housing assembly.

6. The mixing vessel of claim 5, wherein the biocontainer comprises the bottom wall, the top wall, first and second opposing side walls, and third and fourth opposing side walls, the side walls being joined to the top wall and the bottom wall.

7. The mixing vessel of claim 6, further comprising at least one additional port, the additional port comprising a liquid inlet port, a gas inlet port, a gas outlet port, a powder inlet port, an acid/base inlet port, a probe port, and/or a sample port.

8. The mixing vessel of claim 5, further comprising at least one additional port, the additional port comprising a liquid inlet port, a gas inlet port, a gas outlet port, a powder inlet port, an acid/base inlet port, a probe port, and/or a sample port.

* * * * *